US007845997B2

(12) United States Patent
Shiomi et al.

(10) Patent No.: US 7,845,997 B2
(45) Date of Patent: Dec. 7, 2010

(54) BOAT-PROPELLING MACHINE

(75) Inventors: Kazuyuki Shiomi, Wako (JP); Tetsuro Ikeno, Wako (JP); Takeshi Okada, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 135 days.

(21) Appl. No.: 12/064,582

(22) PCT Filed: Aug. 18, 2006

(86) PCT No.: PCT/JP2006/316658

§ 371 (c)(1),
(2), (4) Date: Feb. 22, 2008

(87) PCT Pub. No.: WO2007/023924

PCT Pub. Date: Mar. 1, 2007

(65) Prior Publication Data

US 2009/0163091 A1 Jun. 25, 2009

(30) Foreign Application Priority Data

Aug. 22, 2005 (JP) ..... 2005-240110

(51) Int. Cl.

| | |
|---|---|
| ***B63H 5/20*** | (2006.01) |
| ***B63H 5/125*** | (2006.01) |
| ***B63H 20/08*** | (2006.01) |
| *B63B 1/24* | (2006.01) |
| *B63B 1/26* | (2006.01) |

(52) U.S. Cl. ..... 440/53; 114/274

(58) Field of Classification Search ..... 114/271, 114/274, 280–282, 284; 440/49, 53, 66, 440/76

See application file for complete search history.

(56) References Cited

U.S. PATENT DOCUMENTS

| | | | |
|---|---|---|---|
| 1,576,237 | A | 3/1926 | Dawson |
| 2,748,400 | A | 6/1956 | Casimir |
| 2,860,594 | A | 11/1958 | Kiekhaefer |
| 2,959,148 | A | 11/1960 | Donald |
| 3,433,195 | A | 3/1969 | Poole |
| 4,096,819 | A | 6/1978 | Evinrude |

(Continued)

FOREIGN PATENT DOCUMENTS

FR 2616744 A 12/1988

(Continued)

OTHER PUBLICATIONS

International Search Report of PCT/JP2006/316658, date of mailing Nov. 17, 2006.

(Continued)

*Primary Examiner*—Daniel V Venne
(74) *Attorney, Agent, or Firm*—Westerman, Hattori, Daniels & Adrian, LLP

(57) ABSTRACT

In a boat-propelling machine for attachment to a boat hull (200), an outer wall unit (4) is fixedly provided on a body of the machine for covering part of a cylindrical structural body (60) that is formed of metal alloy and positioned so as to be at least above a draft line during planning of the boat, and a lift force generation device (20) is provided on the outer vertical wall unit.

2 Claims, 7 Drawing Sheets

U.S. PATENT DOCUMENTS

| | | | | | |
|---|---|---|---|---|---|
| 4,205,618 | A | | 6/1980 | Olsson | |
| 4,738,644 | A | * | 4/1988 | Happel | 440/76 |
| 4,781,632 | A | | 11/1988 | Litjens et al. | |
| 4,948,384 | A | * | 8/1990 | Bland et al. | 440/78 |
| 5,178,089 | A | * | 1/1993 | Hodel | 114/274 |
| 5,203,275 | A | | 4/1993 | Brauner | |
| 5,307,754 | A | | 5/1994 | Leonardis | |
| 5,638,765 | A | * | 6/1997 | Poulos | 114/274 |
| 5,645,009 | A | | 7/1997 | Lexau | |

FOREIGN PATENT DOCUMENTS

| | | | |
|---|---|---|---|
| GB | 1005565 | A | 9/1965 |
| JP | 57-60995 | A | 4/1982 |
| JP | 59-130799 | A | 7/1984 |

OTHER PUBLICATIONS

Japanese Office Action dated Feb. 19, 2010, issued in corresponding Japanese Patent Application No. 2005-239995 (With English Translation).

Japanese Office Action dated Feb. 19, 2010, issued in corresponding Japanese Patent Application No. 2005-240120 ( With English Translation).

* cited by examiner

BOAT-PROPELLING MACHINE

TECHNICAL FIELD

The present invention relates generally to boats having boat-propelling machines attached thereto and, more particularly, to an improved boat-propelling machine provided with a lift force generation device that, as the boat starts planning on the surface of water from a stopped state, lifts upward the boat-propelling machine to thereby allow the boat to readily shift to smooth planing on the surface of water.

BACKGROUND ART

Boats which plane on the surface of water with one or more boat-propelling machines generally take, in a non-planing state or prior to start of planing on the surface of water, a forwardly-and-upwardly inclined posture or position with the bow raised and the stern lowered and partly submerged under water; the boats start planing in such an inclined position. At the beginning of planing on the surface of water, a sufficient boat speed can hardly be obtained due to a great water resistance.

In order to secure certain speeds, it is necessary that the boat body (i.e., hull) take a substantial horizontal posture with the stern raised to a certain degree; however, it would take a considerably long time for the boat hull to assume such a substantial horizontal posture, so that smooth acceleration can not be readily achieved.

Thus, lift force generation devices for lifting upward the stern and boat-propelling machine at the beginning of planing travel are proposed, for example, in Japanese Patent Laid-Open Publication Nos. SHO-57-60995 and SHO-59-130799 (hereinafter "Patent Document 1" and "Patent Document 2", respectively).

The lift force generation device disclosed in Patent Document 1 includes a cavitation plate and splash plate mounted on a portion of a lower casing of the boat-propelling machine above a propeller, and an acceleration plate mounted above the cavitation plate and splash plate. The acceleration plate is in the form of a flat plate that projects leftward and rightward and forward and rearward from the lower casing, with the forward projecting amount of the acceleration plate being smaller than the rearward projecting amount.

Further, the right force generation device disclosed in Patent Document 2 includes a cavitation-preventing plate mounted above the propeller of the boat-propelling machine, and a buoyancy plate of a wing-like sectional shape mounted above the cavitation-preventing plate.

In each of the lift force generation devices disclosed in Patent Document 1 and Patent Document 2, the acceleration plate or buoyancy plate is fixed to a projecting section of a body part of the boat-propelling machine via stays or bolted to threaded portions of the body above the propeller; namely, the acceleration plate or buoyancy plate is fixed via a local mounting structure.

Where the acceleration plate or buoyancy plate is unnecessary and thus not mounted on the body of the boat-propelling machine, the mounting section for the acceleration plate or buoyancy plate is exposed on the body, so that the outer appearance of the boat-propelling machine would be aesthetically impaired.

Further, the lift force generation device disclosed in Patent Document 1 would encounter a structural limitation of a mounting bracket. In any case, because the large body of the boat-propelling machine has the dedicated mounting structure, there would arise inconveniences, such as high manufacturing cost of the body part.

Furthermore, because the acceleration plate disclosed in Patent Document 1 is in the form of a flat plate that does not greatly extend rearward up to or beyond the rear end of the propeller, the boat's stern normally partly submerged under water can not be lifted up quickly and smoothly at the beginning of planning operation of the boat-propelling machine. As a consequence, it would take a long time for the boat's hull to assume a substantial horizontal posture, so that smooth acceleration tends to be difficult to achieve.

Furthermore, the buoyancy plate of a wing-like sectional shape, disclosed in Patent Document 2, has a smaller length in the front-rear direction than the cavitation-preventing plate and has its rear end located forward of the rear end of the cavitation-preventing plate. Thus, as with the acceleration plate disclosed in Patent Document 1, the boat's stern normally partly submerged under water can not be lifted up quickly and smoothly at the beginning of planning operation of the boat-propelling machine. As a consequence, it would take a long time for the boat's hull to assume a substantial horizontal posture, so that smooth acceleration tends to be difficult to achieve.

DISCLOSURE OF THE INVENTION

In view of the foregoing, it is an object of the present invention to provide a boat-propelling machine which can perform a superior boat-propelling function and can also achieve an enhanced outer appearance of its body part.

In order to accomplish the above-mentioned object, the present invention provides an improved boat-propelling machine for attachment to a body of a boat (boat hull), which comprises: an outer wall unit fixedly provided on a body of the machine for covering part of a cylindrical structural body that is formed of metal alloy and provided to be located above at least a draft line during planning travel of the boat; and a lift force generation device provided on the outer vertical wall unit.

In the present invention, the body of the boat-propelling machine for attachment to a boat hull includes the outer vertical wall unit fixedly provided for covering part of a cylindrical structural body of light alloy metal that is positioned so as to be located above a draft line during planing travel of the boat on the surface of water, and the lift force generation device is provided on the outer vertical wall unit. According to the present invention, the outer vertical wall unit provided with the lift force generation device is a separate component from the body in the form of a light-alloy cylindrical structural body fixed in the boat-propelling machine, and thus, the light-alloy cylindrical structural body need not have a structure for mounting the lift force generation device. Consequently, the boat-propelling machine of the present invention can be provided with the lift force generation device at low cost. As a result, for a user who requires the lift force generation device, only components parts for fixing the lift force generation device may be prepared as attachments or accessories.

In an embodiment of the present invention, the outer vertical wall unit is dividable into port-side (i.e., left-side) and starboard-side (i.e., right-side) vertical wall members. This arrangement allows the lift force generation device to be readily mounted to the outer periphery of the body and can significantly simplify the necessary mounting structure.

In a preferred embodiment, the boat-propelling machine includes an engine room for housing an engine outside the boat, and the outer vertical wall unit is provided as a separate component from the engine room. The engine room is designed to be located higher than the surface of water to minimize entry of water into the engine room, and components of the engine room have more than certain heights. Because the outer vertical wall unit is provided as a separate component from the engine room, it is possible to avoid increase in size of the component parts for mounting the lift force generation device; namely, for a user who requires the lift force generation device, only components parts for fixing the lift force generation device may be prepared, which is very advantageous from a viewpoint of the cost.

According to another aspect of the present invention, there is provided a boat-propelling machine for attachment to a boat hull, which comprises: a lift force generation device generally comprising a plate-shaped structure; an outer vertical wall unit extending upwardly to a region above at least a draft line during planning travel of the boat and dividable into port-side and starboard-side vertical wall members, the port-side wall of the plate-shaped structure of the outer vertical wall unit including a port-side section of the plate-shaped structure of the lift force generation device, the starboard-side vertical wall member of the outer vertical wall unit including a starboard-side section of the plate-shaped structure of the lift force generation device; and port-side and starboard-side supports connecting between the lift force generation device and portions of the outer vertical wall unit located above corresponding ones of the port-side and starboard-side sections of the plate-shaped structure of the lift force generation device. Because the outer vertical wall unit, provided with the lift force generation device, comprises the dividable port-side and starboard-side vertical wall members each including the plate-shaped structure section and support connecting between the plate-shaped structure section and the vertical wall member, the port-side and starboard-side vertical wall members, plate-shaped structure sections and supports can be readily attached to the outer periphery of the body outer vertical wall unit, which can simplify manufacturing of the machine and also achieve improved traveling performance. Further, because each of the vertical wall members includes the plate-shaped structure section, constituting the lift force generation device, and the support connecting between the plate-shaped structure section and the vertical wall member, the lift force generation device can have high rigidity.

In an embodiment, the port-side vertical wall member, port-side section of the plate-shaped structure and port-side support are formed integrally, and similarly the starboard-side vertical wall member, starboard-side section of the plate-shaped structure and starboard-side support are formed integrally. This arrangement can facilitate necessary assemblying operation, reduce the number of necessary assemblying steps and simplify the overall construction of machine. Further, the integral, continuous formation of the vertical wall member, plate-shaped section and support also achieves enhanced rigidity at boundaries between the vertical wall member, plate-shaped structure section and support.

BEST MODE FOR CARRYING OUT THE INVENTION

Figure 1:
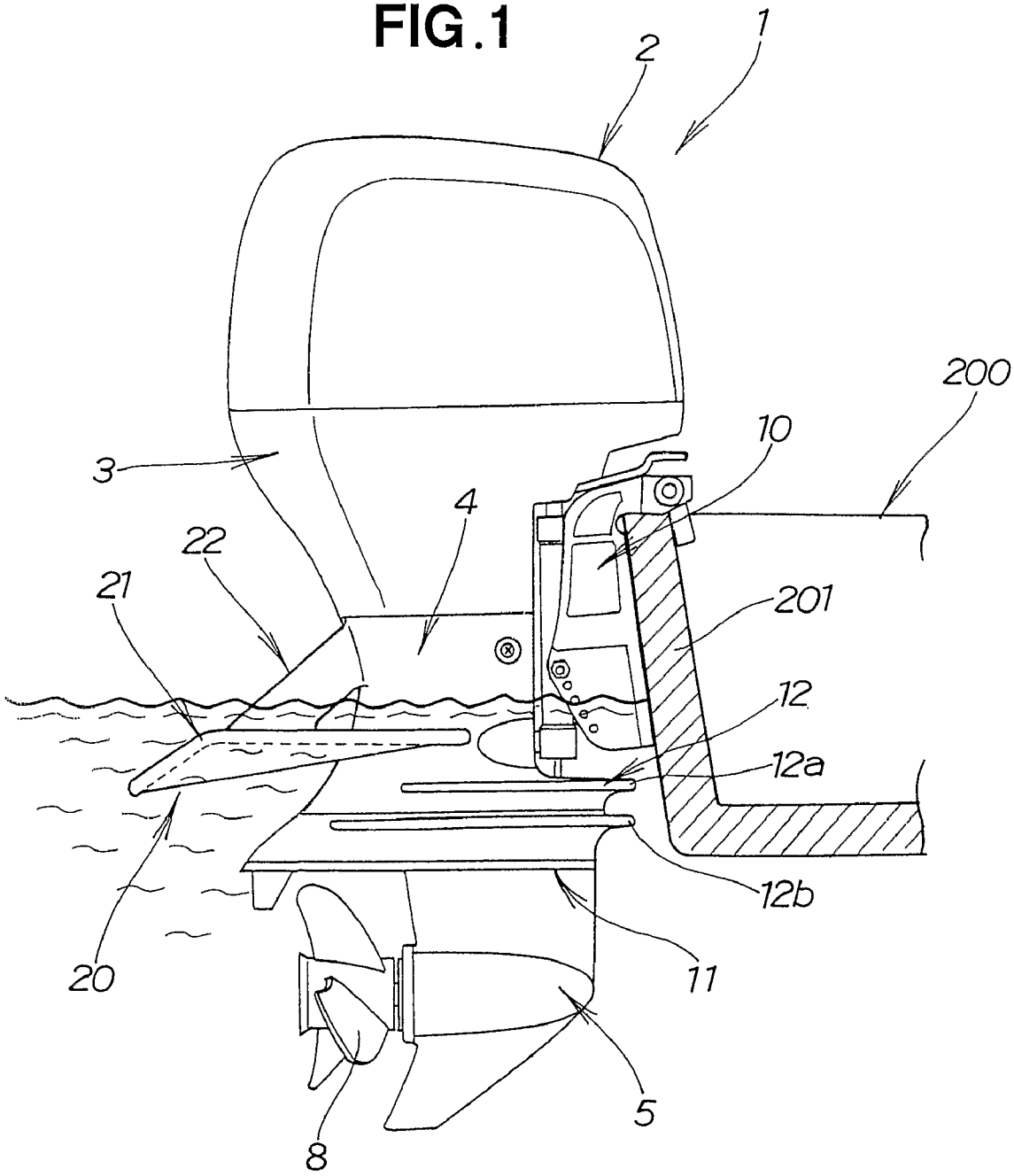
FIG. 1 is a view of a boat-propelling machine in accordance with an embodiment of the present invention, which particularly shows primary portions of the boat-propelling machine mounted to the stern of a boat hull.

FIG. 1 is a view of a boat-propelling machine in accordance with an embodiment of the present invention, which particularly shows primary portions of the boat-propelling machine attached to the stern of a boat hull and relationship between the boat-propelling machine and the boat hull.

The boat-propelling machine 1 is attached to the stern 201 of the boat hull 200 via a stern bracket 10 in such a manner that the machine 1 is not only pivotable in a vertical direction (i.e., tiltable in the up-down direction) but also pivotable in a horizontal direction (i.e., steerable in the left-right direction). The boat hull 200 has its center of gravity (not shown) located more forward, i.e. closer to the center of the hull, than the boat-propelling machine 1.

As clearly seen in FIG. 1, the boat-propelling machine 1 has its lower half section, including a propeller 8, normally submerged under water. Further, the boat-propelling machine 1 includes an anti-cavitation plate 11 and one or more anti-splash plates 12 (in the illustrated example, a, pair of upper and lower anti-splash plates 12*a* and 12*b*) disposed immediately above the anti-cavitation plate 11, and these anti-cavitation plate 11 and anti-splash plates 12*a* and 12*b* are also normally submerged under water.

Figure 2:
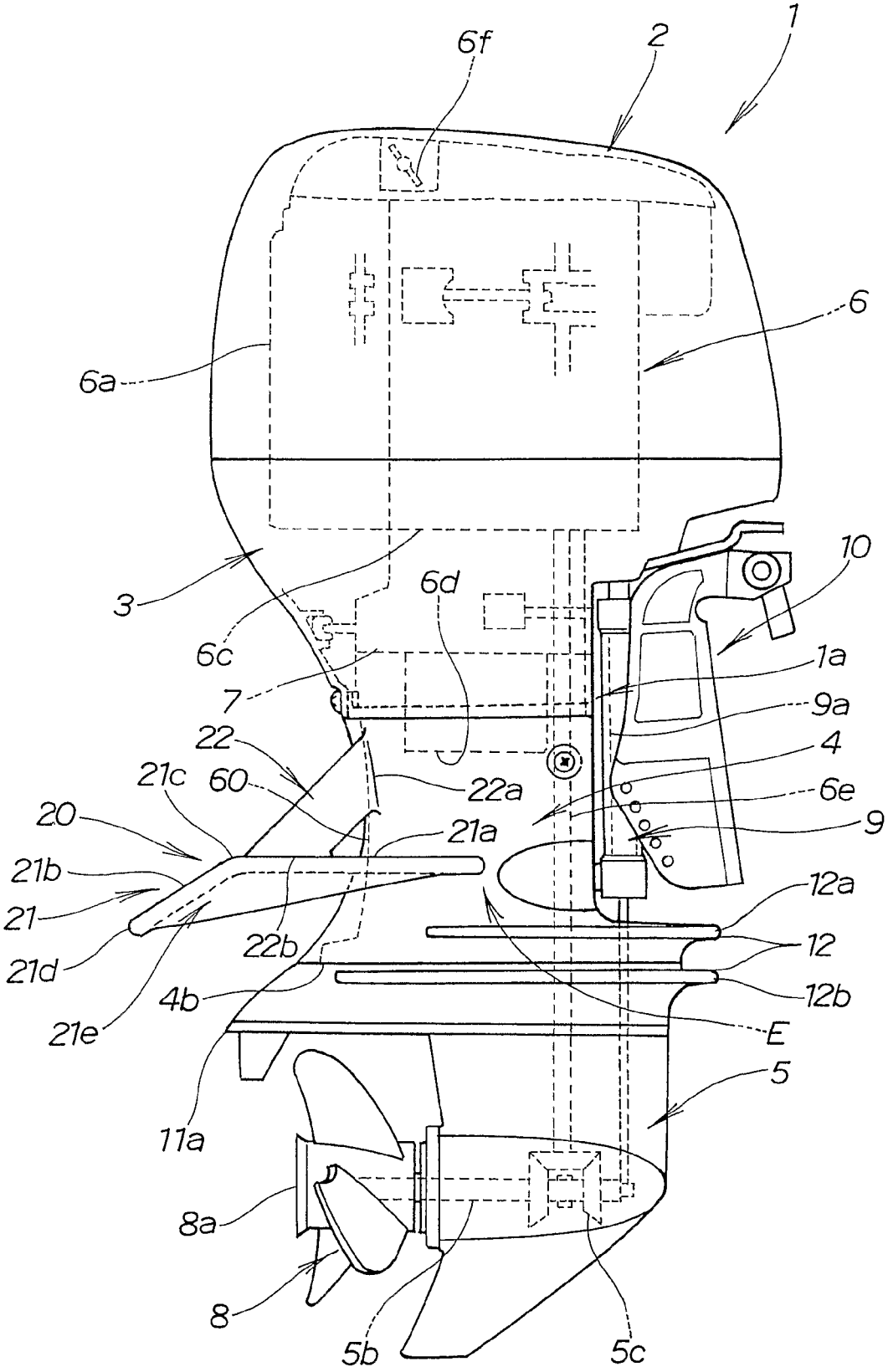
FIG. 2 is a side view showing an outer appearance of the boat-propelling machine of FIG. 1.
Figure 3:
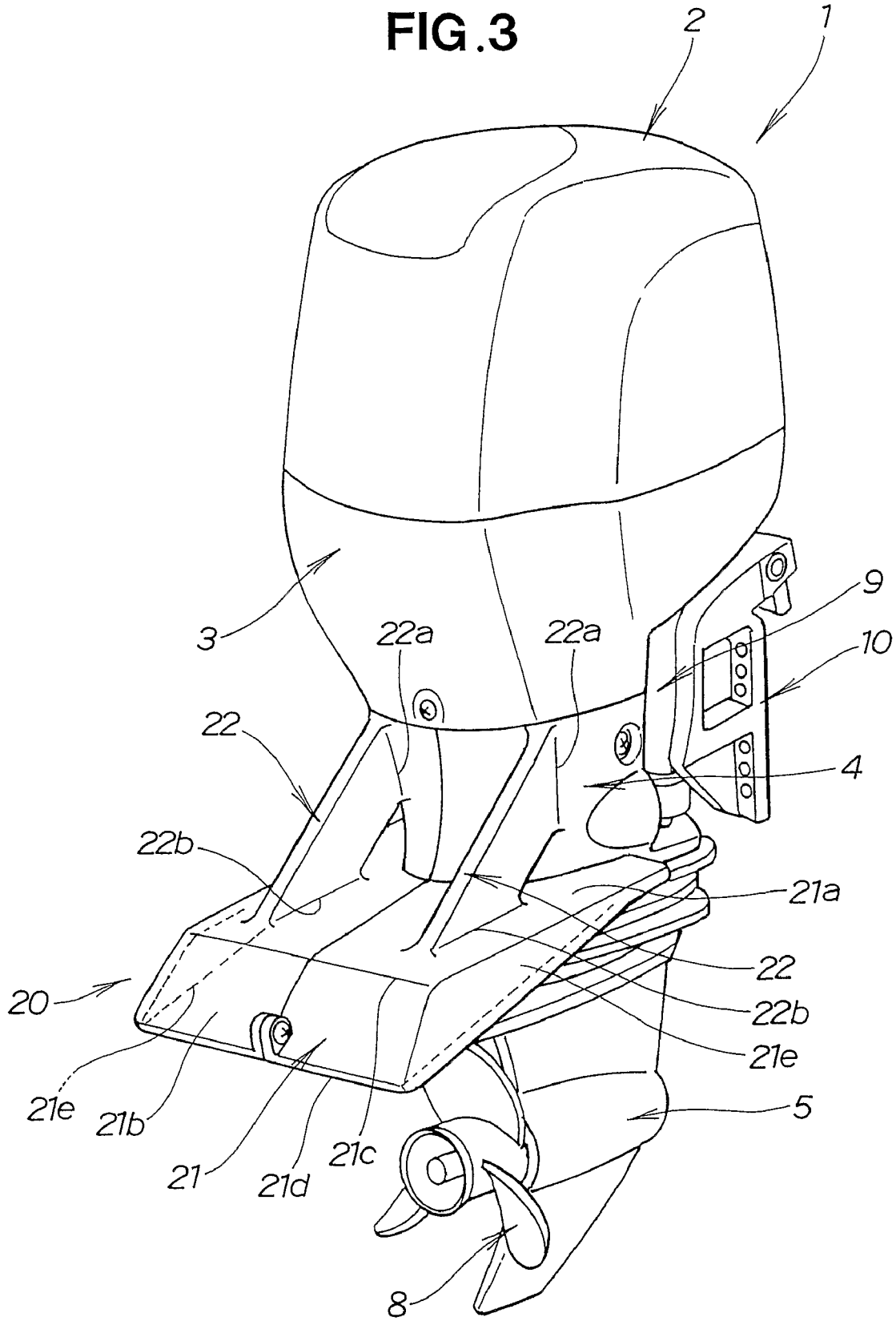
FIG. 3 is a rear perspective view of the boat-propelling machine.
Figure 4:
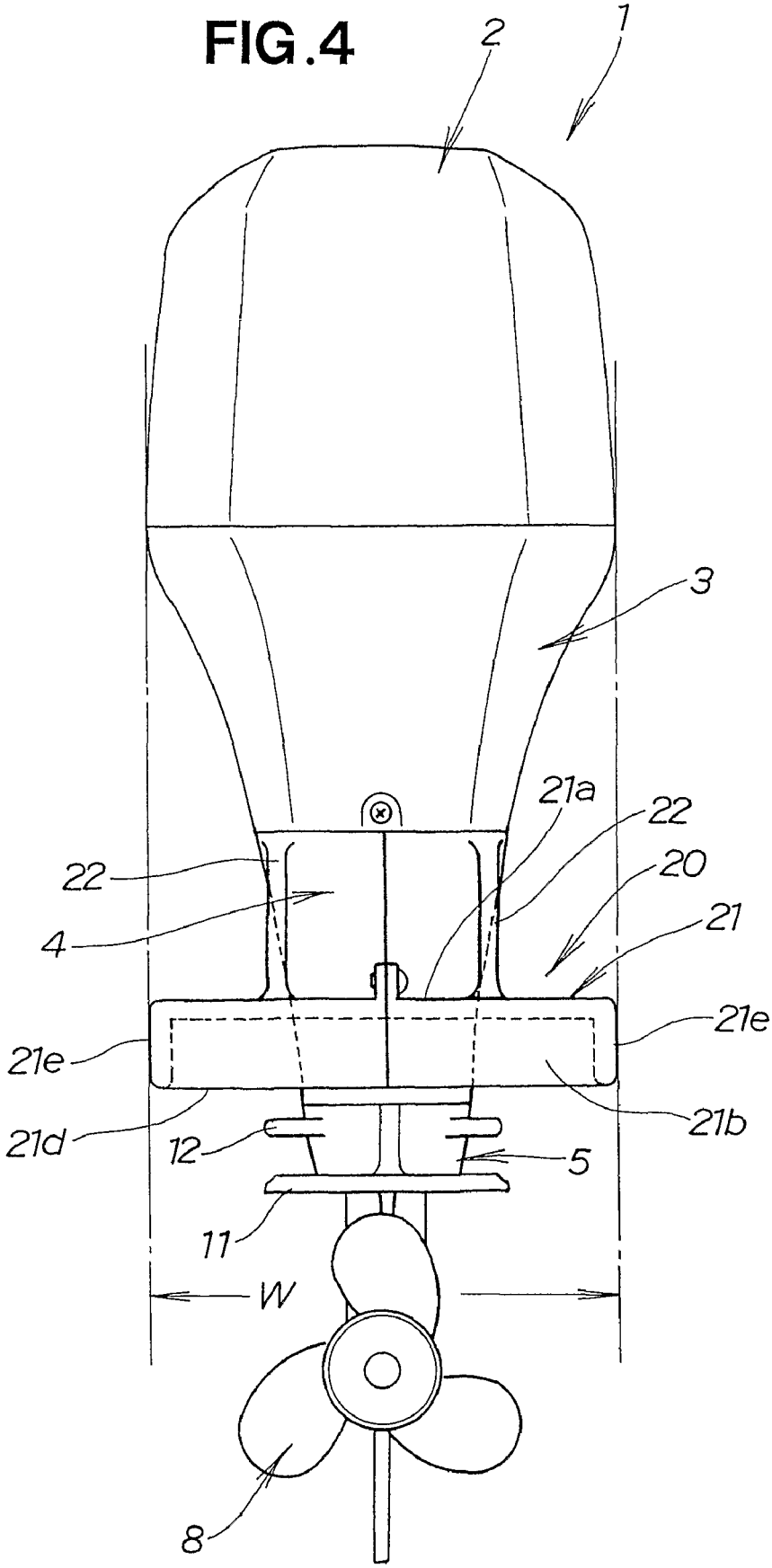
FIG. 4 is a rear end view of the boat-propelling machine.

FIG. 2 is a side view showing an outer appearance of the boat-propelling machine 1, FIG. 3 is a rear perspective view of the boat-propelling machine 1, and FIG. 4 is a rear end view of the boat-propelling machine 1.

As seen from FIGS. 2-4, the boat-propelling machine 1 generally comprises an engine cover 2 constituting an uppermost outer casing section of the machine 1, an under cover 3 disposed beneath the engine cover 2, extension case cover 4 disposed beneath the under cover 3, and a gear case 5 disposed beneath the extension case cover 4. The extension case cover 4 constitutes a vertically-middle section of a body part of the machine 1.

In the instant embodiment, the extension case cover 4 is an outer casing section or outer vertical wall unit that covers a cylindrical structural body formed of light alloy metal, such as aluminum alloy, and constituting an extension case connecting between an engine and the gear case 5 as will be later detailed. The extension case cover (or outer vertical wall unit) 4, providing an outer appearance of the extension case in the aforementioned manner, is formed, separately from the light-alloy cylindrical structural body, of hard synthetic resin or light metal. The gear case 5 is also formed of light metal, such as aluminum alloy.

The aforementioned light-alloy cylindrical structural body (i.e., extension case) is located at least above a draft line of the boat during planing travel on the surface of water, and the extension case cover 4 covers at least part of the outer periphery of the light-alloy cylindrical structural body.

The engine 6, which is in the form of a vertical engine having a crankshaft and camshaft extending in the vertical direction, is disposed within the engine cover 2. More specifically, the engine 6 is a multi-cylindered, four-stroke engine with a plurality of cylinders that have their respective axes oriented horizontally and are arranged in a vertical row.

Main section of the engine 6, including an upper half section of the engine 6, is covered with the engine cover 2, and a lower half section of the engine 6 is covered with an upper section of the under cover 3; the engine cover 2 and under cover 3 thus covering the engine 6 together constitute an engine room.

The engine 6 has, in its rear portion adjacent to the rear end of the boat-propelling machine 1, an engine head 6*a* including a cylinder head and head cover. The engine 6 also has, in its middle portion, an engine body 6*b* including a cylinder block and crankcase, and the engine 6 further has a lower portion facing the under cover 3.

Bottom 6*c* of the engine body is located within the under cover 3, and a mount case 7 containing an oil pan 6*d* is disposed beneath the bottom 6*c* of the engine body. Operation of the engine 6 is controlled via a throttle valve 6*f* etc.

Vertical drive shaft 6*e* extends through the bottom 6*c* of the under cover 3, mount case 7, leg case 60 (see FIG. 6) of the extension case and upper portion of the gear case 5, to drive a gear mechanism 5*c* within a gearbox 5*a* provided in a middle portion of the gear case 5. The propeller 8 for producing a propulsive force is connected to a rear end portion of an output shaft 5*b* driven by the gear mechanism 5*c*.

Namely, the extension case in the form of the light-alloy cylindrical structural body (leg case 60 of FIG. 6) supports the engine body, accommodates therein the drive shaft 6*e* and transmits the propulsive force of the propeller to the boat hull. In the interior of the extension case, there are provided an exhaust passage for directing the exhaust of the engine to a propeller boss outlet 8*a* and an exhaust expansion chamber E.

Vertically-elongated recessed portion, 1*a* is formed in a front portion of the boat-propelling machine 1, and the recessed portion 1*a* extends from a front lower half section of the under cover 3 to a front portion of the extension cover 4. Swivel case 9 and stern bracket 10 are provided in the recessed portion. The boat is steered via the swivel shaft 9*a*, and the boat-propelling machine 1 is vertically tiltable via the stern bracket 10. As noted above, the boat-propelling machine 1 is attached to the stern via the stern bracket 10.

In a lower section of the boat-propelling machine 1, the anti-cavitation plate 11 is provided over and spaced from the propeller 8, and the anti-cavitation plate 11 projects forward and laterally outwardly like a U-shape flange.

The anti-splash plates, 12 (12*a* and 12*b*) are provided over and spaced from the anti-cavitation plate 11. The anti-splash plates 12 each extends from a front portion to opposite intermediate side portions of the machine 1 and projects, like a U-shape flange, forwardly and laterally outward.

In the instant embodiment, the anti-splash plates 12 and anti-cavitation plate 11 are disposed on a lower portion of the extension case cover 4 and upper portion of the gear case 5. Particularly, the upper anti-splash plate 12*a* of the pair of vertically-spaced upper and lower anti-splash plates 12 and 12*b* is provided on the extension case cover 4. In the figure, reference numeral 4*b* represents an abutting surface between the extension case cover 4 and the gear case 5.

The above-described boat-propelling machine 1 is provided with a lift force generation device 20. The following paragraphs describe the lift force generation device 20 with reference to FIGS. 2 to 4.

The lift force generation device 20 comprises a plate-shaped structure 21 extending horizontally rearward from middle regions of opposite outer peripheral portions of a lower half section of the extension case cover that constitutes the outer appearance of the body part (formed by the above-mentioned outer vertical wall unit) of the boat-propelling machine 1. The plate-shaped structure 21 of the lift force generation device 20 is provided over the anti-cavitation plate 11 and anti-splash plates 12*a* and 12*b* in spaced-apart relation thereto.

The plate-shaped structure 21 has a substantially-horizontal front half section (hereinafter referred to as "horizontal section" 21*a*, and a rear slanting section 21*b* extending rearwardly and downwardly. The horizontal section 21*a* and rear slanting section 21*b* integrally connect with each other via an intermediate bent section 21*c* of a substantially-doglegged sectional shape.

The lift force generation device 20 is first made separately from the light-alloy cylindrical structural body, substantially constituting the extension case, and then integrally attached to the cylindrical structural body, as will be later detailed.

The rear slanting section 21*b* extends rearwardly beyond the rear end of the propeller 8 and beyond a rear end 11*a* of the anti-cavitation plate 11; that is, a rear end 21*d* of the rear slanting section 21*b* is located rearwardly of and above the rear end of the propeller 8 and rearwardly of and above the rear end 11*a* of the anti-cavitation plate 11.

Supports 22 extend forwardly and upwardly from intermediate portions, in the front-rear direction, of the horizontal section 21*a* of the plate-shaped structure 21. The supports 22 have respective upper ends 22*a* integrally formed with left and right regions of the rear outer peripheral surface of the extension case cover 4, and respective lower ends integrally formed with the horizontal section 21*a*.

Vertical reinforcing walls 21*e* are formed, as downward projecting walls, integrally with left and right side edge portions of the plate-shaped structure 21, and these walls 21*e* continuously extend from near a front end portion of the horizontal section 21*a*, via the bent section 21*c*, to the rear end of the rear slanting section 21*b*. Alternatively, the reinforcing walls 21*e* may be provided as upward projecting walls formed integrally with the left and right side edge portions of the plate-shaped structure 21.

Figure 5:
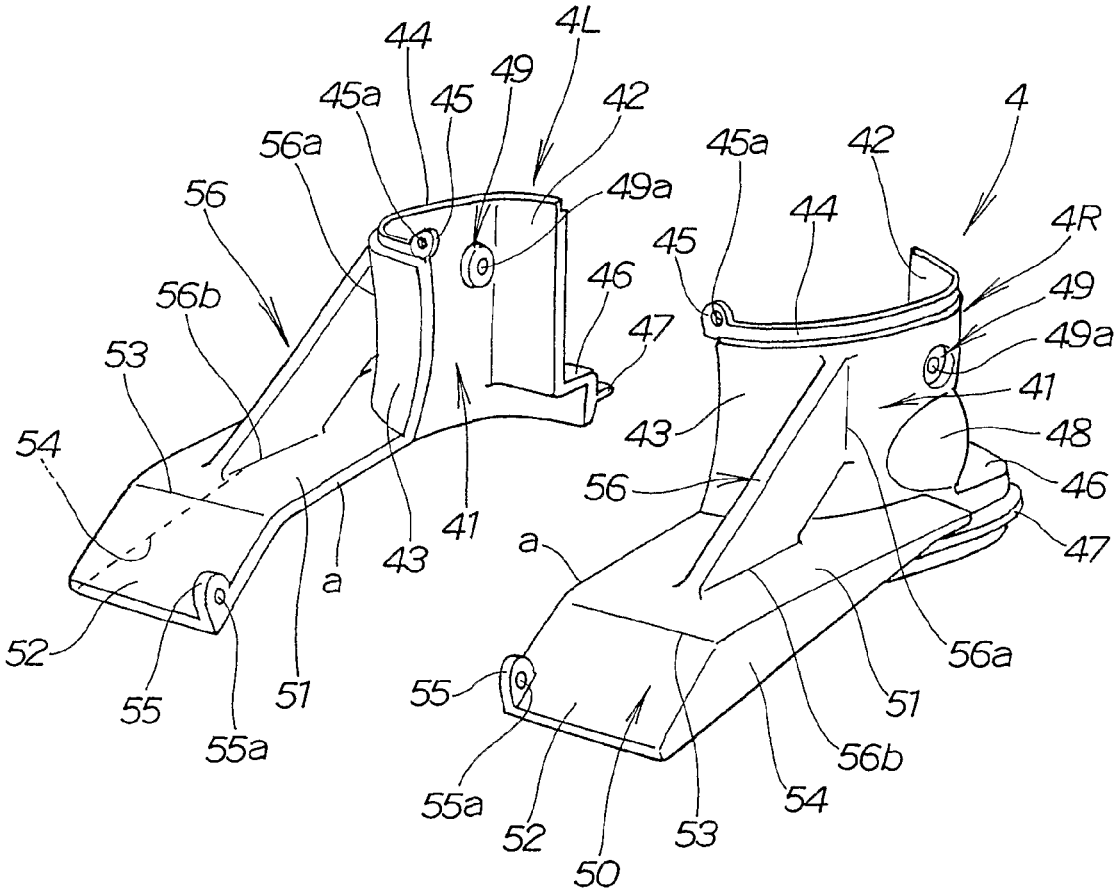
FIG. 5 is an exploded perspective view of an extension case cover including a lift force generation device.

FIG. 5 is an exploded perspective view of the extension case cover (outer vertical wall unit) 4 provided with the lift force generation device and covering the light-alloy cylindrical structural body that constitutes the body of the boat-propelling machine 1.

The extension case cover (outer vertical wall unit) 4 comprises left and right (i.e., port-side and starboard-side) outer vertical wall members 4L and 4R. The left and right outer vertical wall members 4L and 4R each have a vertically-elongated semi-cylindrical section 41, and the respective semi-cylindrical sections 41 of the vertical wall members 4L and 4R are positioned in left-right symmetry to together constitute a cylindrical section.

The left-right symmetric semi-cylindrical sections 41 each have a lower end shelf portion 46 extending forward. Flange portions 47, constituting the upper anti-splash plate, are formed on respective lower regions of the lower end shelf portions 46 so as to and project forward and laterally outwardly from the respective lower regions.

Engaging edge 44 is provided at the upper end edge of each of the left and right semi-cylindrical sections 41 to extend from a front region 42 to a rear region 43 of the semi-cylindrical section 41. These engaging edges 44 of the left and right semi-cylindrical sections 41 engage with a lower end portion of the under cover 3.

Mounting protrusions 45 are provided on rear end portions of the respective engaging edges 44 in left-right symmetric relation to each other, and each of the mounting protrusions 45 has a mounting hole, 45*a*. The mounting protrusions 45 are bolted to a mounting portion provided on a lower-end rear surface of the undercover 3 with the mounting protrusions overlapped with each other in the front-rear direction, as will be later described.

Each of the semi-cylindrical sections 41 integrally has, in the outer surface of its lower half portion, an outwardly-laterally-bulging cover portion 48. The cover portions 48 of the semi-cylindrical sections 41 cover later-described mount housings. Further, each of the semi-cylindrical sections 41 has, on its upper middle side portion, a concave, dish-shaped mounting portion 49 that has a bolt-mounting hole 49*a*.

Each of the semi-cylindrical sections 41 has a plate-shaped section 50 extending rearwardly from a lower end area of the rear region 43, and the plate-shaped sections 50 of the semi-cylindrical sections 41 are positioned in left-right symmetric relation to each other. Each of the plate-shaped section 50 has a horizontal section 51 extending rearwardly from a lower end area of the rear region 43, and a rear slanting section 52 extending rearwardly and downwardly from the horizontal section 51 via an intermediate bent section 53. The horizontal sections 51, rear slanting sections 52 and bent sections 53 of the left and right vertical wall members 4L and 4R constitute the horizontal section 21*a*, rear slanting section 21*b* and bent section 21*c*, respectively, of the lift force generation device 20.

In each of the left and right plate-shaped sections 50, a vertical reinforcing wall 54 is provided, as a downwardly-projecting wall, on outer edge portions of the horizontal section 51, rear slanting surface portion 52 and bent section 53, and the vertical reinforcing wall 54 extends continuously in the front-rear direction.

Further, in each of the left and right plate-shaped sections 50, a support 56 in the form of a relatively thick plate is formed between the upper surface of a middle region, in the left-right direction, of the horizontal section 51 and the outer surface of the rear region 43 of the semi-cylindrical section 41. The support 56 has its upper end 56*a* integrally formed with the outer surface of the rear region 43 of the corresponding semi-cylindrical section 41 and its lower end 56*b* integrally formed with the upper surface of the horizontal section 51 of the plate-shaped section 50, and it extends rearwardly and downwardly from the outer surface of the rear region 43. The supports 56 of the left and right vertical wall members 4L and 4R constitute the left and right supports 22 of the lift force generation device 20.

The outer vertical wall members 4L and 4R can be integrally joined together by linear joining edges a of their respective semi-cylindrical sections 41 being joined in abutted relation to each other.

Further, each of the plate-shaped sections 50 has a upward mounting protrusion 55 formed on its rear end portion facing the joining edge a of the plate-shaped section 50 of the other outer vertical wall member. The mounting protrusion 55 has a mounting hole 55*a*.

Figure 6:
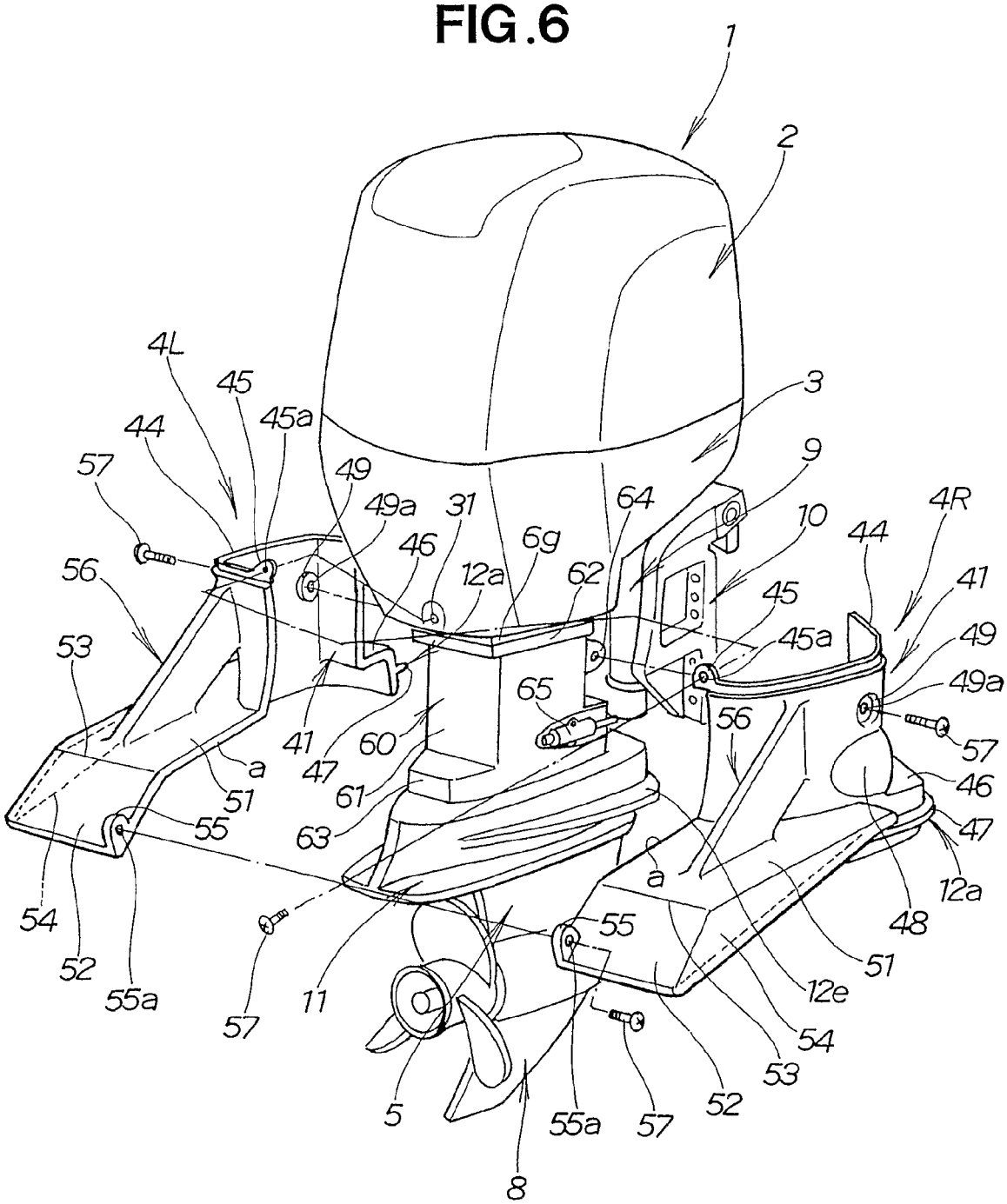
FIG. 6 is an exploded perspective view explanatory of how left and right outer vertical wall members are mounted to a body of the boat-propelling machine.

FIG. 6 is an exploded perspective view explanatory of how the aforementioned left and right (port-side and starboard-side) outer vertical wall members 4L and 4R are mounted to the body of the boat-propelling machine 1, which also shows a rear perspective view of the extension case (light-alloy cylindrical structural body) of the boat-propelling machine 1 with the peripheral elements taken away for clarity.

Although, in fact, the extension case and gear case together constitute the leg case 60, FIG. 6 shows, for convenience, the outer vertical wall members 4L and 4R as assembled to the leg case 60 to cover the outer periphery of the leg case 60.

Upper flange portion 62 of a rectangular-cylindrical body section 61 of the extension case (leg case 60) are joined to a lower end portion of the under cover 3 in overlapped relation thereto via a flange portion 6*g* of the engine-side mount case or the like.

The body section 61 of the leg case 60 has, on its front left and right surfaces, mounting bosses 64. The body section 61 also has the mount housings 65 provided on its lower, front left and front right regions.

The semi-cylindrical sections 41 of the outer vertical wall members 4L and 4R are positioned on the left and right sides of the foot case 60 to thereby sandwich the foot case 60.

Further, the opposed joining edges a of the outer vertical wall members 4L and 4R are abutted and integrally joined together.

Further, the mounting portions 49 of the left and right semi-cylindrical sections 41 are put on the mounting bosses 64 provided of front regions of the body section 61 of the leg case 60, to thereby join, by means of bolts 57, the semi-cylindrical sections 41 to the body section 61 of the leg case 60.

At that time, the outwardly-laterally-bulging cover portions 48 cover the left and right mount housings 65 from outside.

In addition to the joining edges a being jointed together as noted above, the upper-end engaging edges 44 of the semi-cylindrical sections 41 are engaged with inner lower end edges of the under cover 3, the mounting protrusions 45 provided on the respective rear ends of the engaging edges 44 are superposed on each other in the front-rear direction, and the bolts 57 are inserted through the mounting holes 45*a* to integrally join together the sections 41 and under cover 3.

Furthermore, the mounting protrusions 55 of the plate-shaped sections 50 are superposed on each other in the left-right directions and joined together by means of a bolt passed through the mounting holes 55*a*.

In the above-described manner, this invention provides the boat-propelling machine equipped with the lift force generation device shown in FIGS. 2-4. Namely, integral joining of the outer vertical wall members 4L and 4R provides the extension case cover 4, with the thus-joined semi-cylindrical sections 41 providing the body part of the case cover 4. Further, joining of the rearward-extending plate-shaped sections 50 provides the plate-shaped structure 21 of the lift force generation device 20, and the left and right supports 56 provide the left and supports 22 of the lift force generation device 20.

Figure 7:
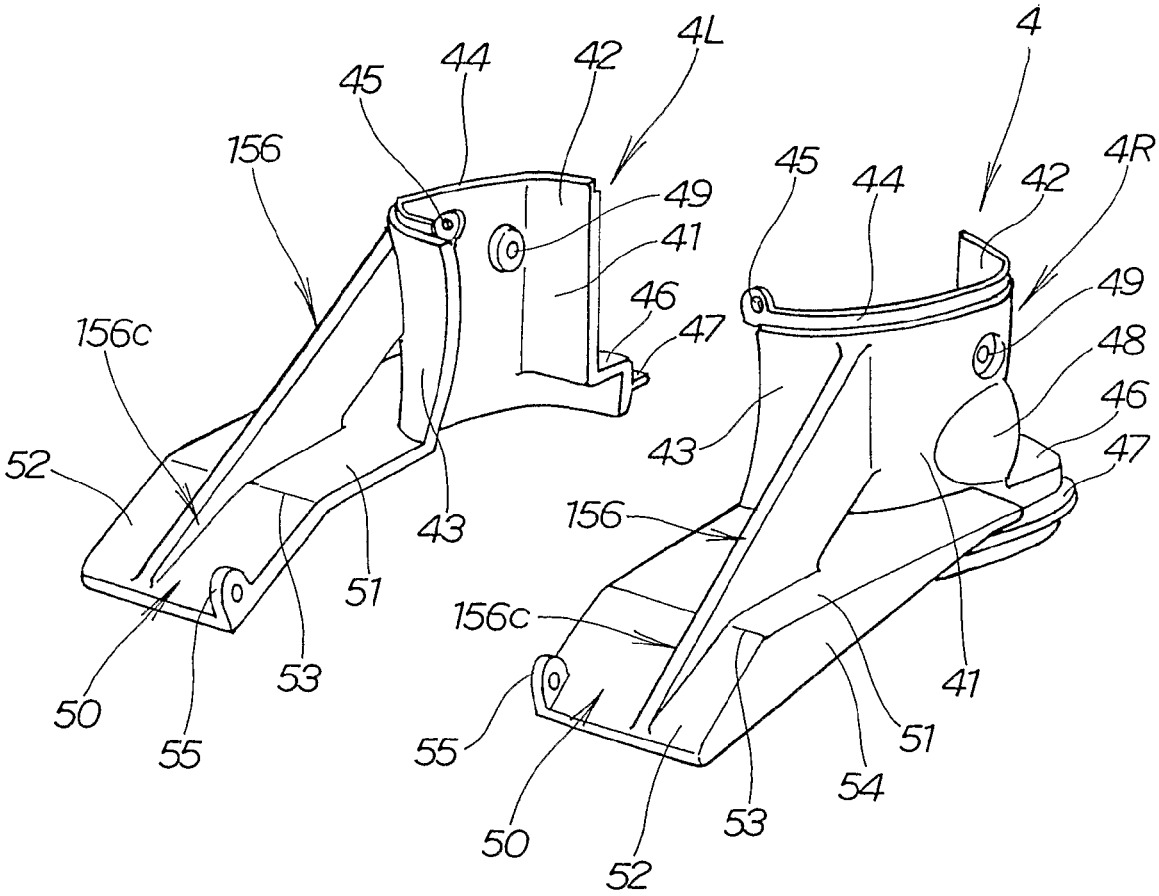
FIG. 7 is an exploded perspective view showing a modification of the outer vertical wall members including the lift force generation device.

FIG. 7 is an exploded perspective view showing a modification of the outer vertical wall members 4L and 4R shown in FIG. 5. Fundamental construction of the modification is, similar to the above-described outer vertical wall members 4L and 4R of FIG. 5, and thus, the same elements as in FIG. 5 are indicated by the same reference characters and will not be described in detail here to avoid unnecessary duplication.

In the modification, supports 156, provided on the outer vertical wall members 4L and 4R, each extend from the horizontal section 51, via the bent section 53, to the rear end of the rear slanting section 52 of the corresponding plate-shaped section 50. Namely, the supports 156 in the modification are different from the supports 56 of FIG. 5 in that they each have an extended reinforcing portion 156*c*.

In the modification, the thus-extended supports 156, provided in addition to the vertical reinforcing wall 54, can even further enhance the rigidity of the plate-shaped sections 50.

In the above-described embodiment and modification, the left and right outer vertical wall members 4L and 4R are each formed integrally of synthetic resin or light alloy metal, and the corresponding elements of the left and right outer vertical wall members 4L and 4R are shaped and positioned in left-right symmetric relation.

It is preferable that the lift force generation device 20 have a width W equal to or smaller than the boat-propelling machine 1 or that the width of the lift force generation device 20 be sufficiently great as compared to the diameter of the propeller 8, for the following reason.

Namely depending on the size etc. of the boat hull, there may be provided a plurality of the aforementioned boat-propelling machines 1, such as two, three or even four. In such a case, the boat is steered by moving the operating directions of the propelling machines leftward or rightward as necessary. However, if the lift force generation devices 20 are greater in width than the corresponding boat-propelling machines 1, the lift force generation devices 20 may undesirably interfere with the steerage. By setting the widths of the lift force generation devices 20 so as not to exceed the widths of the corresponding boat-propelling machines 1, such an inconvenience can be avoided.

The following paragraphs describe behavior of the lift force generation device 20 with reference to FIGS. 1 and 2.

The plate-shaped structure 21 of the lift force generation device 20 encounters a considerable resistance caused by the propulsion of the propelling machine 1, to thereby generate a force to lift upward the propelling machine 1, and hence the stern of the boat, by a pressure difference between the upper and lower surfaces of the rear slanting section 21*b*.

In the resting or stopped state, the boat hull is kept in a posture with the bow slightly raised due to balance between the buoyancy and the center of weight of the boat. Under such conditions, the lower surface of the plate-shaped structure 21 makes a slight angle relative to the horizontal plane, namely, so-called "attack angle".

At the beginning of the propulsion, a force acts on the boat to lower the propelling machine side deeper into water. Under this condition, the propulsion is started, and the boat keeps planning on the surface of water.

Thus, an upward-lifting force acts on the plate-shaped structure 21; because of the downward slanting of the rear slanting surface 21*b*, the lift force effectively works via the rear slanting surface 21*b*.

The lift force acts, as repeated loads, on the rear slanting surface 21*b* and then on the bent section 21*c* and horizontal section 21*a* continuing from the rear slanting surface 21*b*, as well as on other portions peripheral to the portions 21*b*, 21*c* and 21*a*. To deal with Such repeated loads, the reinforcing walls 21*e* are formed integrally with and project from the left and right side edge portions of the plate-shaped structure 21 to extend continuously in the front-rear direction. The reinforcing walls 21*e* can achieve high rigidity and reliably support the loads. With the reinforcing walls 21*e*, the lift force generation device 20 can have high rigidity against deflecting forces applied to the plate-shaped structure 21 in the left-right and front-rear directions. Thus, with the reinforcing walls 21*e* and supports 22, the lift force generation device 20 can have enhanced rigidity in the front-rear and left-right directions and thereby perform its lift force generating function smoothly and reliably.

INDUSTRIAL APPLICABILITY

The basic principles of the present invention can be suitably applied to boat-propelling machines, such as outboard and inboard engines, for attachment to sterns of boat hulls, to allow the boats to make a quick and smooth shift to high-speed planning travel at the beginning of propulsion by the machines.

The invention claimed is:

1. A boat-propelling machine for attachment to a boat hull, comprising:

a lift force generation device generally comprising a plate-shaped structure;

an outer vertical wall unit extending upwardly to a region above at least a draft line during planing travel of the boat and dividable into separately formed port-side and starboard-side vertical wall members, the port-side vertical wall member of said outer vertical wall unit including a port-side section of the plate-shaped structure of said lift force generation device, the starboard-side vertical wall member of said outer vertical wall unit including a starboard-side section of the plate-shaped structure of said lift force generation device; and port-side and starboard-side supports extending rearwardly from respective port-side and starboard-side vertical wall members of said outer vertical wall, and connecting to at least a rear portion of respective port-side and starboard-side sections of the plate shaped structure of said lift force generation device, the port-side and starboard-side portions of said outer vertical wall unit being located above, the port-side and starboard-side sections of the plate-shaped structure of said lift force generation device.

2. The boat-propelling machine of claim 1 wherein said port-side vertical wall member, port-side section of the plate-shaped structure and port-side support are formed integrally, and said starboard-side vertical wall member, starboard-side section of the plate-shaped structure and starboard-side support are formed integrally.

* * * * *